US006503016B2

(12) United States Patent
Raps et al.

(10) Patent No.: US 6,503,016 B2
(45) Date of Patent: Jan. 7, 2003

(54) APPLICATION IMPLEMENT

(75) Inventors: Jürgen Raps, Hof (DE); Jochen Griesheimer, Schwarzenbach (DE); Daniel Baum, Schwarzenbach am Wald (DE)

(73) Assignee: A.W. Faber-Castell Unternehmensverwaltung GmbH & Co., Stein (DE)

( * ) Notice: Subject to any disclaimer, the term of this patent is extended or adjusted under 35 U.S.C. 154(b) by 0 days.

(21) Appl. No.: 09/982,183

(22) Filed: Oct. 17, 2001

(65) Prior Publication Data

US 2002/0081141 A1 Jun. 27, 2002

Related U.S. Application Data

(63) Continuation of application No. PCT/EP00/03434, filed on Apr. 15, 2000.

(51) Int. Cl.[7] ..... B43K 8/06; B43K 5/14; B43K 5/18

(52) U.S. Cl. ..... 401/198; 401/199; 401/205

(58) Field of Search ..... 401/198, 199, 401/205

(56) References Cited

U.S. PATENT DOCUMENTS

| | | | | |
|---|---|---|---|---|
| 4,588,319 A | * | 5/1986 | Niemeyer | 401/205 |
| 6,113,296 A | * | 9/2000 | Weiss | 401/199 |
| 6,176,633 B1 | * | 1/2001 | Andrews et al. | 401/232 |

FOREIGN PATENT DOCUMENTS

| | | |
|---|---|---|
| DE | 38 22 985 A | 1/1990 |
| DE | 39 10 787 C1 | 9/1990 |
| DE | 197 07 383 A 1 | 8/1998 |
| EP | 0 210 469 A2 | 2/1987 |
| GB | 715042 | 9/1954 |

* cited by examiner

*Primary Examiner*—Steven O. Douglas
*Assistant Examiner*—Kathleen J. Prunner
(74) *Attorney, Agent, or Firm*—Laurence A. Greenberg; Werner H. Stemer; Ralph E. Locher

(57) ABSTRACT

A device for applying a fluid, notably a writing pen or cosmetic pencil, includes a tubular shaft, a fluid container that is positioned therein, a tip, and a conducting system for the fluid. The container ensures constant pressure equalization with the atmosphere by having its front and rear ends each being fluidically connected to the atmosphere. At the rear end of the container a ventilation opening is positioned. The ventilation opening opens into the container interior containing the fluid and is sealed by a semi-permeable membrane.

22 Claims, 13 Drawing Sheets

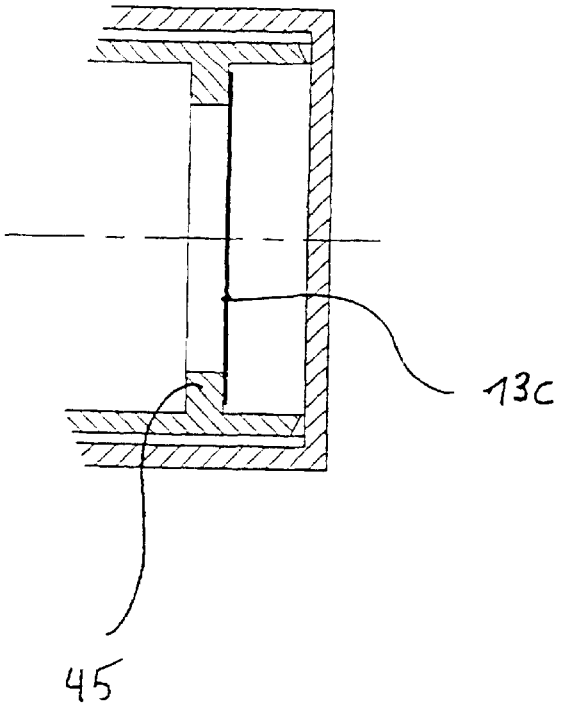
Fig. 11
Fig. 12
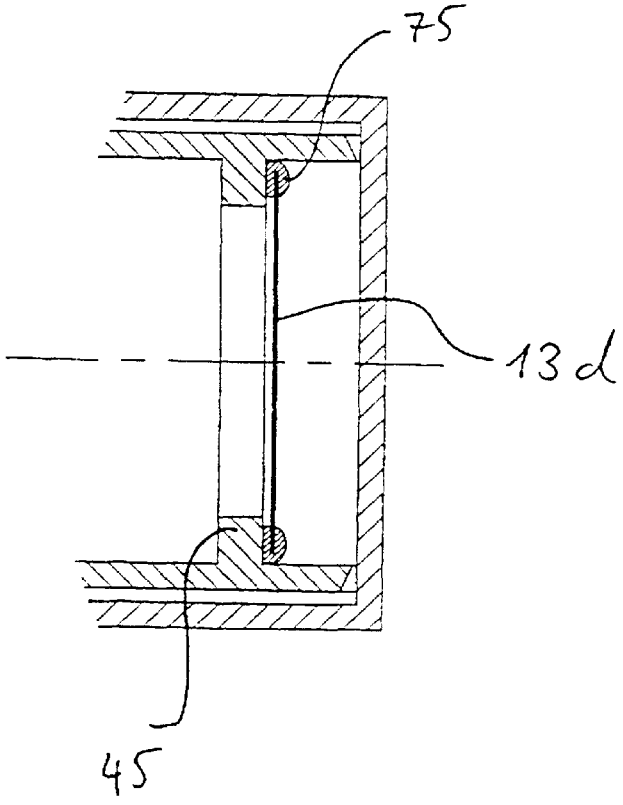

APPLICATION IMPLEMENT

CROSS REFERENCE TO RELATED APPLICATION

This application is a continuation of copending International Application No. PCT/EP00/03434, filed Apr. 15, 2000, which designated the United States.

BACKGROUND OF THE INVENTION

Field of the Invention

The invention relates to an implement for applying a fluid, in particular, a stick-like writing or cosmetics implement. Such a prior art application implement, for example, is disclosed in German Patent DE 3910787 C1, the implement having a sleeve-like shank. A container for accommodating a fluid is disposed in the shank. Also provided is a fluid-directing system that, on one hand, bears a writing tip and, on the other hand, is in contact with the interior of the fluid container. The front end of the container is in fluidic connection with the atmosphere through an air-admission opening that is closed off by a semi-permeable diaphragm. As a result of which, air admission to, and air extraction from, the container is achieved with the writing tip retained in the upward direction. To ensure air admission and air extraction (for simplicity, reference is only made to air admission hereinbelow) in the case of an application implement with the writing tip retained in the downward direction, the prior art application implement has a transverse wall drawn into the container that includes, at least in part, a semi-permeable diaphragm that is impermeable to fluid and is permeable to air and water vapor. The transverse wall is joined, on the shank side, by a pressure-equalization chamber that is subdivided by a lip-valve-bearing transverse wall. Finally, an air-admission opening is provided in the shank-side or rear end wall of the container.

British Patent Document GB 715,043 discloses a ball-point pen in which the fluid container is connected to the atmosphere by way of its rear end through a semi-permeable diaphragm. The diaphragm includes a non-porous elastic material, e.g., of latex, and allows the through-passage of air on account of molecular diffusion.

SUMMARY OF THE INVENTION

It is accordingly an object of the invention to provide an application implement that overcomes the hereinaforementioned disadvantages of the heretofore-known devices of this general type and that, with a straightforward construction, has a container that ensures constant pressure equalization with the atmosphere with the writing tip retained in the downward direction, that is to say during use, and with the writing tip retained in the upward direction as well as in the case of all other conceivable storage and use positions.

With the foregoing and other objects in view, there is provided, in accordance with the invention, an implement for applying a fluid, including a sleeve-like shank having a container, the container having an interior accommodating a fluid, a front end, a rear end, at least one of the front end and the rear end fluidically connected to the atmosphere for admitting air into and extracting air from the interior, and at least one air-admission opening connecting the interior to the atmosphere, a diaphragm permeable to air and impermeable to the fluid, the diaphragm closing off the air-admission opening, a writing tip of a capillary material, the tip connected to the shank, and a fluid-directing system fluidically connecting the writing tip to the fluid in the interior with the capillary material, the fluid-directing system directing fluid from the interior of the container to the writing tip. Preferably, the implement is a stick-like writing or cosmetics implement.

In accordance with another feature of the invention, the air-admission opening is disposed at the rear end of the container.

According to the application implement of the invention, there is disposed, at the rear end of the container, an air-admission opening that opens out directly into the fluid-containing container interior and is closed off by a semi-permeable diaphragm, i.e., one that is permeable to air and is impermeable to fluid. The construction makes it possible for the interior of the shank to be utilized to better effect and, thus, for a larger quantity of fluid to be stored. In the application implement disclosed from German Patent DE 3910787 C1, an air chamber is provided in the container, to the detriment of the quantity of fluid that can be stored. It has been found that the air admission in the writing position is possible even without an air-filled auxiliary chamber with lip valves disposed therein. The absence of such a construction feature simplifies the production of the application implement.

In accordance with a further feature of the invention, there is provided a second diaphragm permeable to air and impermeable to the fluid. The air-admission opening includes an air-admission opening at the front end, and the second diaphragm closes off the air-admission opening at the front end.

The air admission to the application implement with the writing tip retained in the upward direction preferably takes place through at least one air-admission opening that is disposed at the front end of the container and is likewise closed off by a semi-permeable diaphragm. The diaphragms are disposed, for example, adhesively bonded, on the outside or inside of the respective container wall having the air-admission opening. A configuration that further simplifies the production provides that the component having the air-admission opening is an injection molding with a diaphragm molded therein. It is, thus, possible for the container as a whole to be provided with the diaphragm during its production. As a result, there is no need for the diaphragm to be fixed subsequently on the container.

In accordance with an added feature of the invention, the container has a container wall with an inside surface and an outside surface, and the diaphragm and the second diaphragm are each disposed on one of the group consisting of the outside surface and the inside surface.

In accordance with an additional feature of the invention, the container is made by injection molding with the diaphragm molded therein.

In accordance with yet another feature of the invention, the container is made by injection molding with at least one of the diaphragm and the second diaphragm molded therein.

In a configuration that simplifies the production and the assembly, the fluid-directing system includes a tube with an essentially radially projecting flange that forms the front end wall of the container. The tube, the flange, and the container are preferably integral. As a result, on one hand, the assembly is facilitated and, on the other hand, leakages between the flange and container are avoided.

In accordance with yet a further feature of the invention, the fluid-directing system has a tube with a substantially radially projecting flange, and the flange forms a front end wall of the container.

In accordance with yet an added feature of the invention, the tube, the flange, and the container are integral and/or are formed in one piece.

In accordance with yet an additional feature of the invention, the circumferential wall of the container is formed by the shank itself, which reduces the number of parts and, thus, the assembly outlay.

In accordance with again another feature of the invention, the shank has a rear end and an outside, a stopper has an inside and closes off the rear end of the shank, and an air-admission channel fluidically communicating with the atmosphere is disposed between the inside of the stopper and the outside of the shank.

In accordance with again a further feature of the invention, a separate container is disposed in the shank. The air admission to the container through a diaphragm disposed at the rear end of the container is made possible in that an air channel that communicates with the diaphragm is provided between the outside of the sleeve and the inside of the shank.

In accordance with again an added feature of the invention, the container has an outer surface, the shank has an inner surface, the at least one air-admission opening is at least one rear air-admission opening, and an air channel is disposed between the outer surface of the container and the inner surface of the shank and fluidically communicates with the at least one rear air-admission opening.

In accordance with again an additional feature of the invention, the air channel opens out into a cavity that is connected to the atmosphere and is disposed between the tube of the fluid-directing system and an essentially sleeve-like tip part that encloses the fluid-directing system at a radial spacing therefrom. In the case of the separate container, an air-admission opening may be provided in the circumferential wall of the container. The configuration is associated, first of all, with the advantage that the air-admission opening may be of larger configuration than in the case of a configuration in an end wall of the container. In the case of the front end wall, in particular, the end-wall surface area available for air-admission openings is small because a bore has to be provided here through which the fluid-directing system can remove fluid from the container.

In accordance with still another feature of the invention, the air-admission opening in the circumferential wall of the container is at least one elongate air-admission opening extending from the front end of the container to the rear end of the container.

It is particularly advantageous if at least one elongate air-admission opening extends from the tip end of the container to the shank end of the latter. The configuration ensures air admission more or less in every position of the stick-like implement, particularly if a plurality of such elongate air-admission openings distributed over the container circumference is provided. It is possible to achieve the same effect as with the plurality of elongate air-admission openings if one air-admission opening extends helically over the container circumference. In such a case, as is also the case with the plurality of rectilinear elongate air-admission openings, air admission to the interior of the container is also possible in any desired rotary position—in relation to the longitudinal axis of the application implement as axis of rotation.

In accordance with still a further feature of the invention, the container is an exchangeable cartridge.

In accordance with still an added feature of the invention, the cartridge has a front end wall defining a central opening, the fluid-directing system has a tube with a rear end, and the rear end of the tube is inserted releaseably into the central opening.

In accordance with still an additional feature of the invention, the fluid-directing system has a tube with an interior having an inner cross-section, the writing tip has a rear longitudinal section disposed in the tube, an insert is disposed in the interior of the tube and narrows the inner cross-section to form at least one longitudinally extending fluid channel in the interior of the tube, and the fluid channel adjoins the writing tip and fluidically communicates with the atmosphere for admitting air into and extracting air from the front end of the container.

In accordance with still another feature of the invention, the tube has an inner tube wall, the insert has a circumferential section abutting the inner tube wall, and at least one flattened portion disposed at a distance from the inner tube wall, and the inner tube wall and the flattened portion define the fluid channel.

In accordance with a concomitant feature of the invention, the fluid channel has a cross-sectional surface area decreasing in a direction of the container.

In a further inventive configuration, an insert that narrows the interior of the tube of the fluid device is disposed in the interior. The narrowing in cross-section makes it possible to produce axially running fluid channels that are considerably larger than the capillaries of a fibrous or sintered material and, thus, subject the fluid to a smaller capillary pressure. The high capillary pressure of the conventional materials involves the risk, in the case of application implements with free fluid stores, of fluid dripping out of the writing tip retained in the downward direction. Such a risk is prevented by the proposed configuration of the fluid-directing system. With the writing tip retained in the upward direction, it is possible to dissipate heating-induced pressure in the container through a fluid channel and an air channel provided between the writing tip and the inner wall of the tube. Conversely, air can penetrate into the container through the same route. It is, thus, possible to dispense with a diaphragm-closed air-admission opening in the front container region.

Other features that are considered as characteristic for the invention are set forth in the appended claims.

Although the invention is illustrated and described herein as embodied in an application implement, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 11 is an enlarged, fragmentary, cross-sectional view of a shank end of the application implement according to FIG. 3 with an alternative diaphragm embodiment;

FIG. 12 is an enlarged, fragmentary, cross-sectional view of a shank end of the application implement according to FIG. 3 with a second alternative diaphragm embodiment;

DESCRIPTION OF THE PREFERRED EMBODIMENTS

Figure 1:
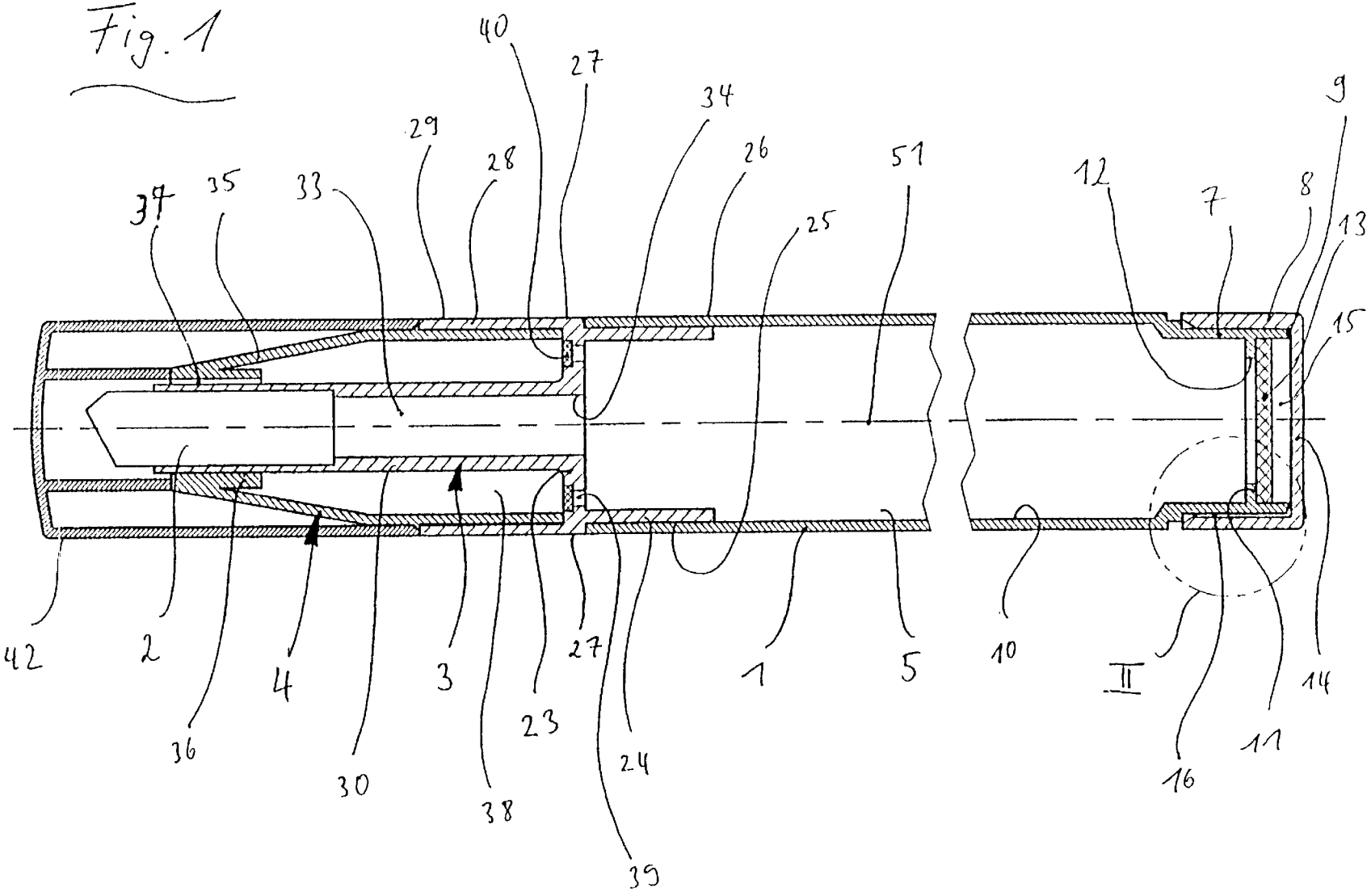
FIG. 1 is a fragmentary, longitudinal, cross-sectional view of a first embodiment of an application implement according to the invention.
Figure 2:
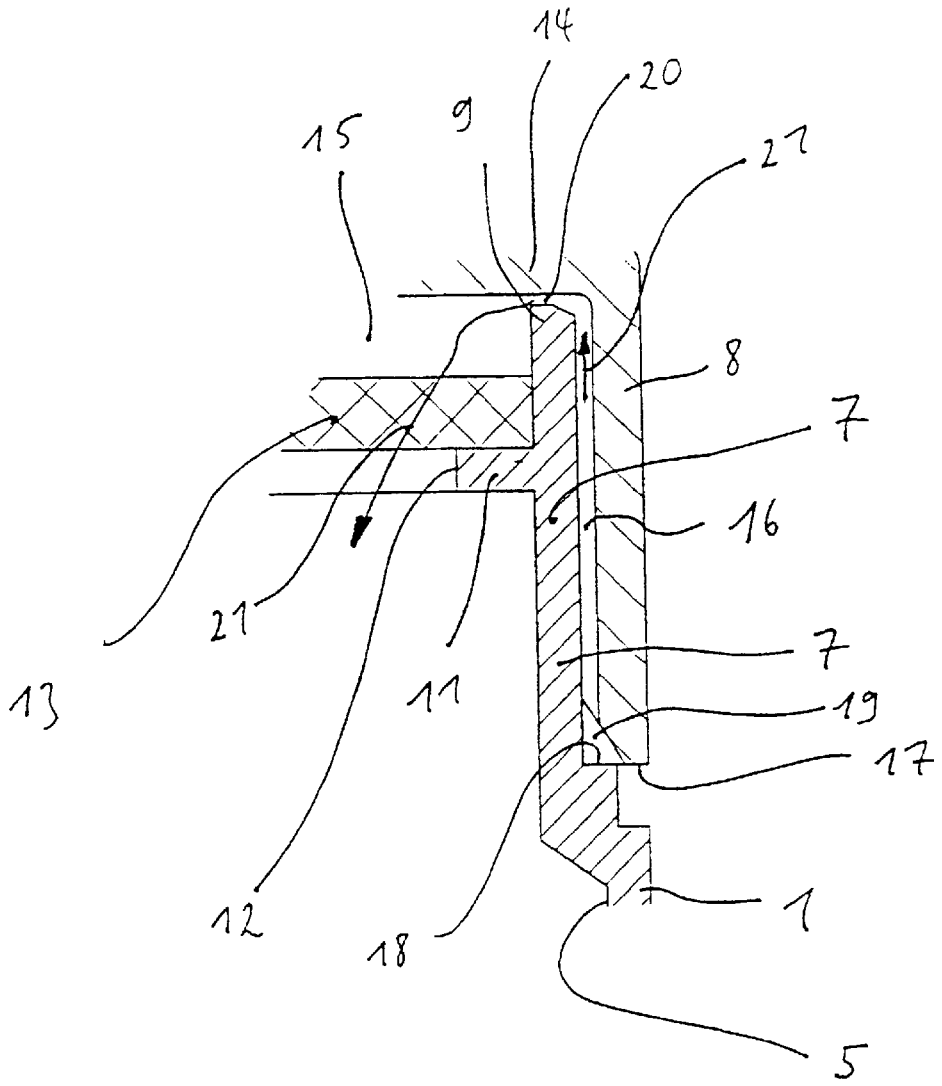
FIG. 2 is an enlarged, fragmentary, cross-sectional view of the detail II of FIG. 1.

Referring now to the figures of the drawings in detail and first, particularly to FIG. 1 thereof and also the other exemplary embodiments, there is shown essentially a sleeve-like shank 1, a fluid-directing system 3, which retains a writing tip 2, and a sleeve-like tip part 4, which encloses the fluid-directing system 3 at a radial spacing therefrom. The shank 1 itself forms a container 5 for a writing fluid or for a cosmetics fluid. The rear end of the shank 1 has a region 7 that is drawn radially inward and onto which an essentially cup-like stopper 8 is fitted. The stopper 8 is fixed on the shank preferably by adhesive bonding or ultrasonic welding. Within the region 7, an end wall 11 is integrally formed on the inner surface 10 of the shank. The inner wall 10 extends radially inward and has a central air-admission opening 12 passing through it. A semi-permeable diaphragm 13 is fixed on the outside of the end wall 11. The outside is directed away from the writing tip 2. The axial spacing between the end wall 11 and the base 14 of the stopper 8 is dimensioned such that there is also an axial spacing or a cavity 15 provided between the diaphragm 13 and the base 14. The cavity 15 communicates with the atmosphere through an air-admission channel 16, which is disposed between the stopper 8 and the narrowed region 7 of the shank 1. The stopper 8 butts by way of its end side 17, against a radially outwardly extending radial shoulder 18 of the shank 1 (see FIG. 2). In the region of the air-admission channel 16, a groove 19 is made in the end side 17. The groove 19 connects the air-admission channel 16 to the atmosphere. The air-admission channel 16 is connected to the cavity 15 through at least one groove 20 in the end side 9 of the shank 1.

The diaphragm 13 prevents fluid from being able to pass out of the container 5. However, the diaphragm 13 allows air admission to the container in the direction of the arrow 21 when the fluid supply decreases during use of the application implement, that is to say in the writing position of the implement. With the container contents heating up in such a position, air can escape outward, in the opposite direction, into the atmosphere. It is, thus, possible for constant pressure equalization to take place in the container 5 during use of the application implement.

The front end of the container 5 is closed off by a flange 23, which is part of the fluid-directing system 3. Integrally formed on that side of the flange 23 that is oriented away from the writing tip 2 is a tube section 24 that extends into the shank 1 and butts against the inner surface 10 of the shank by way of its outer surface 25. The connection between the tube section 24 and the shank 1 takes place, for example, through adhesive bonding. The tube section 24 is offset radially inward to such an extent that the outer surface 26 of the shank 1 is aligned with the border surface 27 of the flange 23. Integrally formed on the other side of the flange 23 is a further tube section 28, of which the outer surface 29 is aligned with the border surface 27. The tip part 4 has its rear end positioned in the tube section 28 and encloses a tube 30, integrally formed on the flange 23, at a radial spacing therefrom. At the front side of the tube 30 is the writing tip 2. In the region of the tube 30 that adjoins the writing tip 2 is a capillary material 33 formed, for example, from plastic fibers or a sintered plastic. The tube 30, flange 23, and capillary material 33 together form the fluid-directing system. The capillary material 33 is in fluidic connection with the interior of the container 5 through a central through-passage opening 34 in the flange 23. The front region 35 of the tip part 4 tapers conically in the direction of the writing tip 2 and is connected integrally, at its front end, to a tube section 36, which encloses the tube 30. Disposed between the tube 30 and the tube section 36 is an air-admission channel 37 that connects the interior of the tip part 4, or the cavity 38 disposed between the tip part 4 and the tube 30, to the atmosphere.

Finally, a plurality of air-admission openings 39 is also provided in the flange 23. The openings 39 widen radially in a step-like manner in the direction of the writing tip 2. A semi-permeable diaphragm 40 is inserted into the radially widened opening region in each case. The diaphragm 40 is fixed on the flange 23, or in the widened region of the air-admission opening 39, for example, by adhesive bonding.

If the writing implement illustrated in FIG. 1 is retained with the writing tip 2 in the upward direction, an air cushion forms in front of the air-admission openings 39. In the case of heating-induced expansion of such an air cushion, air can pass, through the air-admission openings 39 and the semi-permeable diaphragms 40, into the cavity 38 and, from there, into the atmosphere through the air-admission channel 37, provided the protective cap 42 that is customary for application implements of the present type has been removed.

Figure 3:
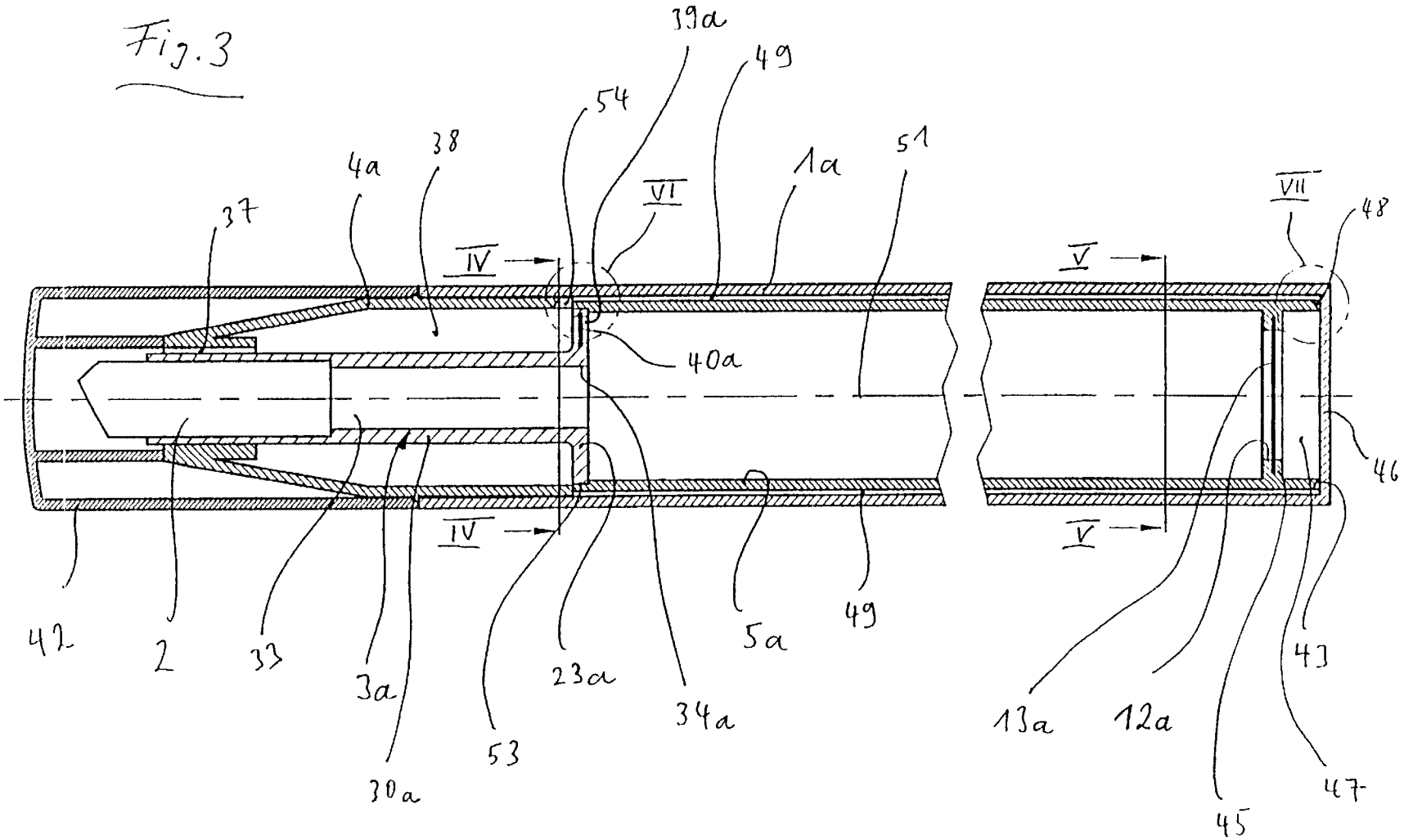
FIG. 3 is a fragmentary, longitudinal, cross-sectional view of a second embodiment of the application implement of FIG. 1.
Figure 6:
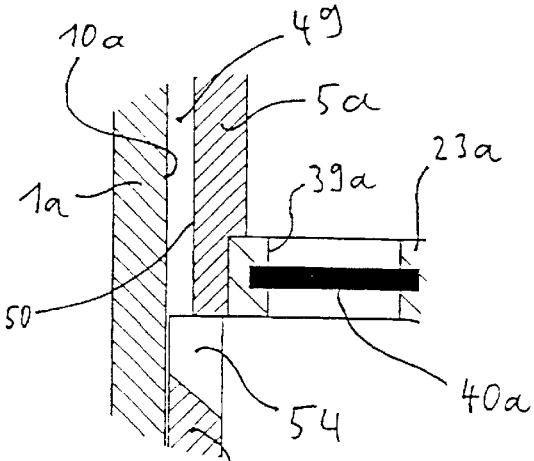
FIG. 6 is an enlarged, fragmentary, cross-sectional view of the detail VI in FIG. 3.
Figure 7:
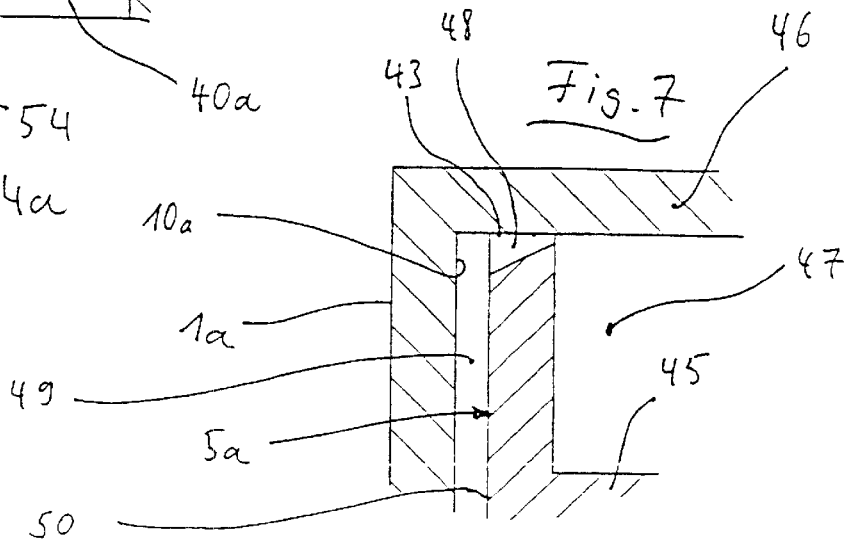
FIG. 7 is an enlarged, fragmentary, cross-sectional view of the detail VII in FIG. 3.

In the exemplary embodiment according to FIG. 3, the fluid container 5*a* is formed by a separate sleeve inserted into the shank 1*a*. The rear end of the sleeve is directed away from the writing tip 2, has an end wall 45 that is spaced apart from the end side 43 of the sleeve, and is provided with a central air-admission opening 12*a*. A semi-permeable diaphragm 13*a* is embedded, by way of its border regions, in the end wall 45, which projects radially inward in the manner of an annular protrusion. An axial spacing, and, thus, a cavity 47, is provided between the end wall 45 or the diaphragm 13*a* and the base 46 of the shank 1*a*. The cavity 47 is connected, through at least one groove 48 in the end side 43 of the container 5*a*, to an air-admission channel 49, which is provided between the outside 50 of the container 5*a* (see FIG. 6) and the inner surface 10*a* of the shank 1 and extends axially or in the direction of the center longitudinal axis 51 of the application implement. The air-admission channel 49 may extend over the entire circumference of the container 5*a*. It is also conceivable, however, for the outside 50 to be provided with a plurality of non-illustrated grooves extending in the direction of the center longitudinal axis 51.

The front end wall of the container 5*a* is formed by a flange 23*a*, which is part of the fluid-directing system 3. The flange 23*a* is inserted into an accommodating groove 53 at the front end of the container 5*a* and is, for example, adhesively bonded or ultrasonically welded there. The tube 30*a* projects from the front side of the flange 23*a* and is in fluidic connection with the container 5*a* through a through-passage opening 34*a* in the flange 23*a*. The tube 30*a* bears the writing tip 2 at its front end and is likewise filled with a capillary material 33.

Figure 4:
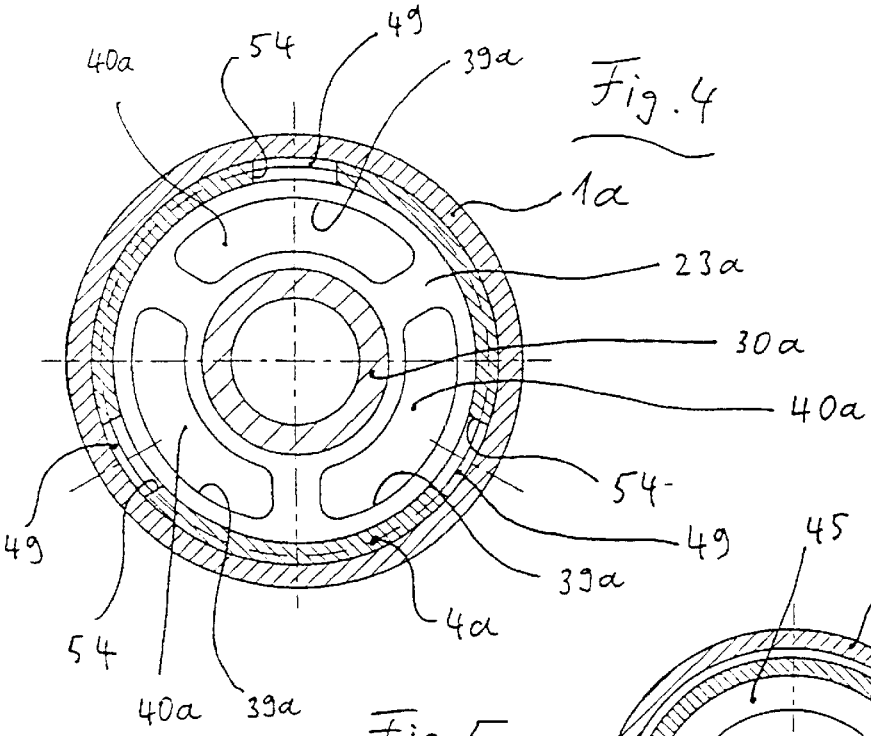
FIG. 4 is an enlarged, cross-sectional view of the embodiment of FIG. 3 across line IV—IV.
Figure 5:
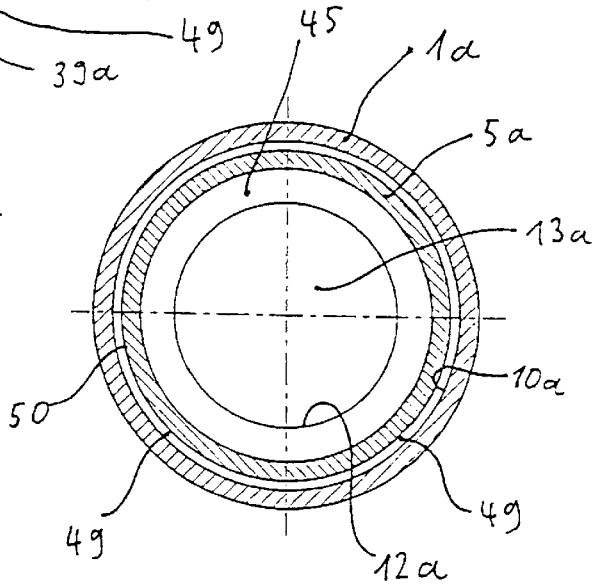
FIG. 5 is an enlarged, cross-sectional view of the embodiment of FIG. 3 across line V—V.

The tip part 4*a* has its shank end side butting against the end side of the container 5*a*. The fluidic connection between the air-admission channel 49 and the cavity 38 takes place through a groove 54 in the end side of the tip part 4*a*, the end side being directed away from the writing tip 2. See also FIGS. 4 and 6. The flange 23*a* has a total of three air-admission openings 39*a*, approximately the form of circle arcs, passing through it. In each case, one diaphragm 40*a* is inserted into the air-admission openings 39*a*, the diaphragm 40*a* being embedded, by way of its border region, in the plastic material of the flange 23*a*, that is to say, being encapsulated by the injection-molded plastic material thereof. As can be gathered from FIG. 5, in particular, the air-admission channel 49 encloses the container 5*a* over its entire circumference. Each air-admission opening 39*a* is assigned a groove 54. See FIG. 4.

Figure 8:
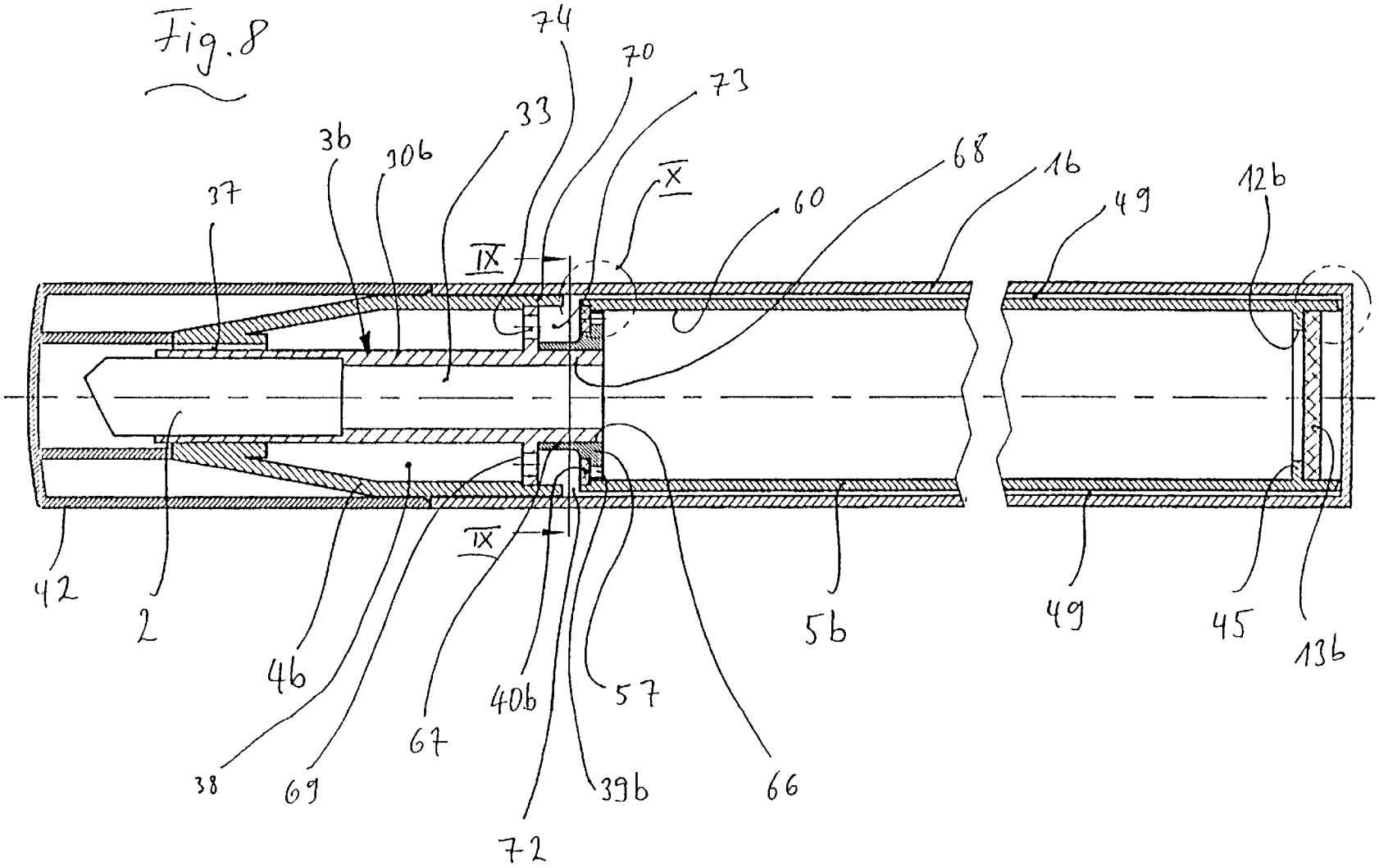
FIG. 8 is a fragmentary, longitudinal, cross-sectional view of a third embodiment of the application implement of FIG. 1.
Figure 9:
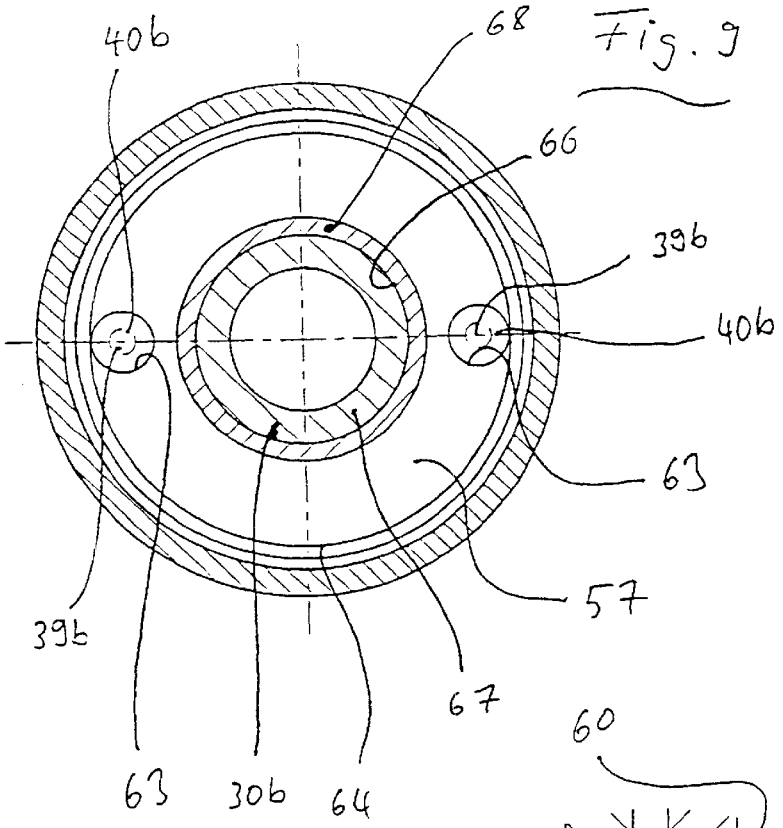
FIG. 9 is an enlarged, cross-sectional view of the embodiment of FIG. 8 across line IX—IX.
Figure 10:
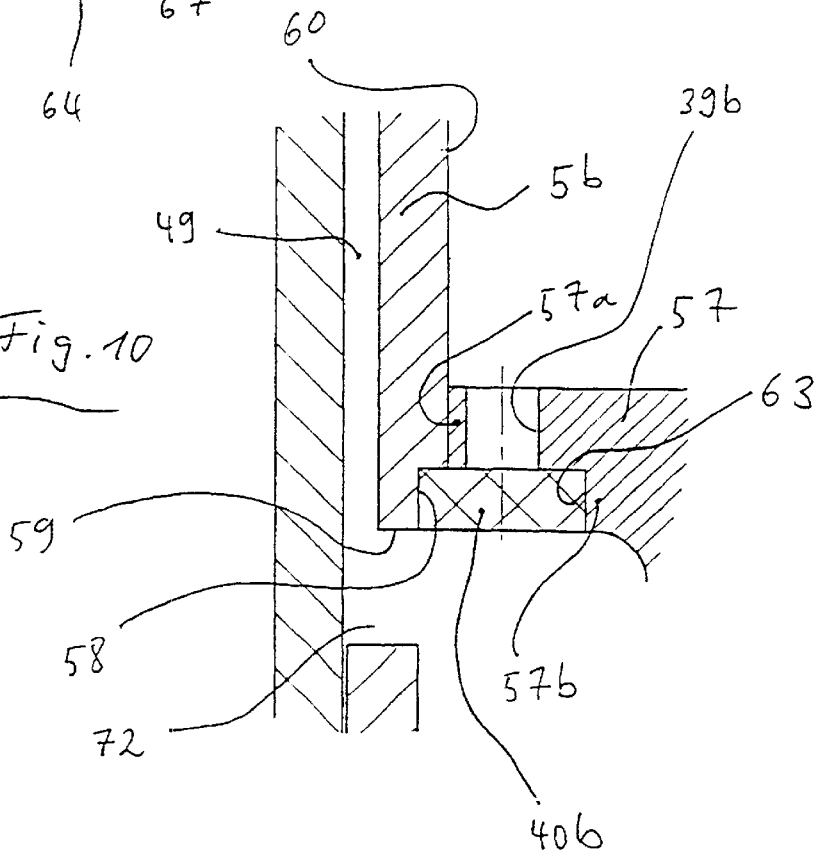
FIG. 10 is an enlarged, fragmentary, cross-sectional view of the detail X in FIG. 8.

In the exemplary embodiment illustrated in FIG. 8, the container 5*b* is configured as an exchangeable cartridge. The rear end of the container 5*b* is configured similarly to the rear end in the exemplary embodiment according to FIG. 3, although the semi-permeable diaphragm 13*b* is fixed on the outside of the end wall 45. A flange 57 forms the tip end wall of the container 5*b*. The flange 57 has a first longitudinal section 57*a* and a second, radially widened longitudinal section 57*b*. See FIG. 10. The section 57*a* butts against the inner surface 60 of the container. The second longitudinal section has the section 57*b*, which projects radially beyond the first longitudinal section 57*a*, positioned in a recess 58 in the end side 59 of the container 5*b*. Provided in the flange 57 are two diametrically opposite air-admission openings 39*b*, which merge into a radially widened region 63 in the direction of the writing tip 2. The region 63, just like the air-admission opening 39*b* as a whole, is circular in cross-section and extends as far as the border 64 of the flange 57. See FIG. 9 in particular. In each case, one semi-permeable diaphragm 40*b* is inserted into the radially widened region 63 of the air-admission openings 39*a*.

A central through-passage opening 66 is provided in the flange 57 and continues into the interior of a tube section 67, which projects from the flange on the tip side. The tube 30*b* is positioned in the tube section 67 and is supported thereon by way of a flange 69 projecting radially outward from its circumference. The tip part 4*b* is fitted over the flange 69, and fixed thereon, by way of a longitudinal section 70 that is widened radially inward. An air-admission channel 49 that is configured in the same way as in the exemplary embodiment according to FIG. 3 is provided between the container 5*b* and the shank 1*b*. A radial spacing 72 is provided between the mutually facing end sides of the container 5*b* and the tip part 4*b* and creates a connection between the air-admission channel 49 and the space 73 provided between the two flanges 69, 57. The space 73 is connected, through bores 74 in the flange 69, to the cavity 38 enclosed by the tip part 4*b*, the cavity 38, in turn, communicating with the atmosphere through the air-admission channel 37.

FIGS. 11 and 12 illustrate further possible ways of configuring a semi-permeable diaphragm and of fixing the same on an end wall. According to FIG. 11, the diaphragm 13*c* is a sheet that is fixed on the outside of the end wall 45, for example, by adhesive bonding. In the exemplary embodiment according to FIG. 12, the diaphragm 13*d*, formed, for example, likewise as a sheet, is fixed in a retaining ring 75 by way of its border. The retaining ring 75 is fastened on the outside of the end wall 45. The method of configuring and fixing the diaphragms 13*c*, 13*d* that is illustrated in FIGS. 11 and 12 may obviously be applied to all air-admission openings, on the outside and inside, of an application implement.

Figure 13:
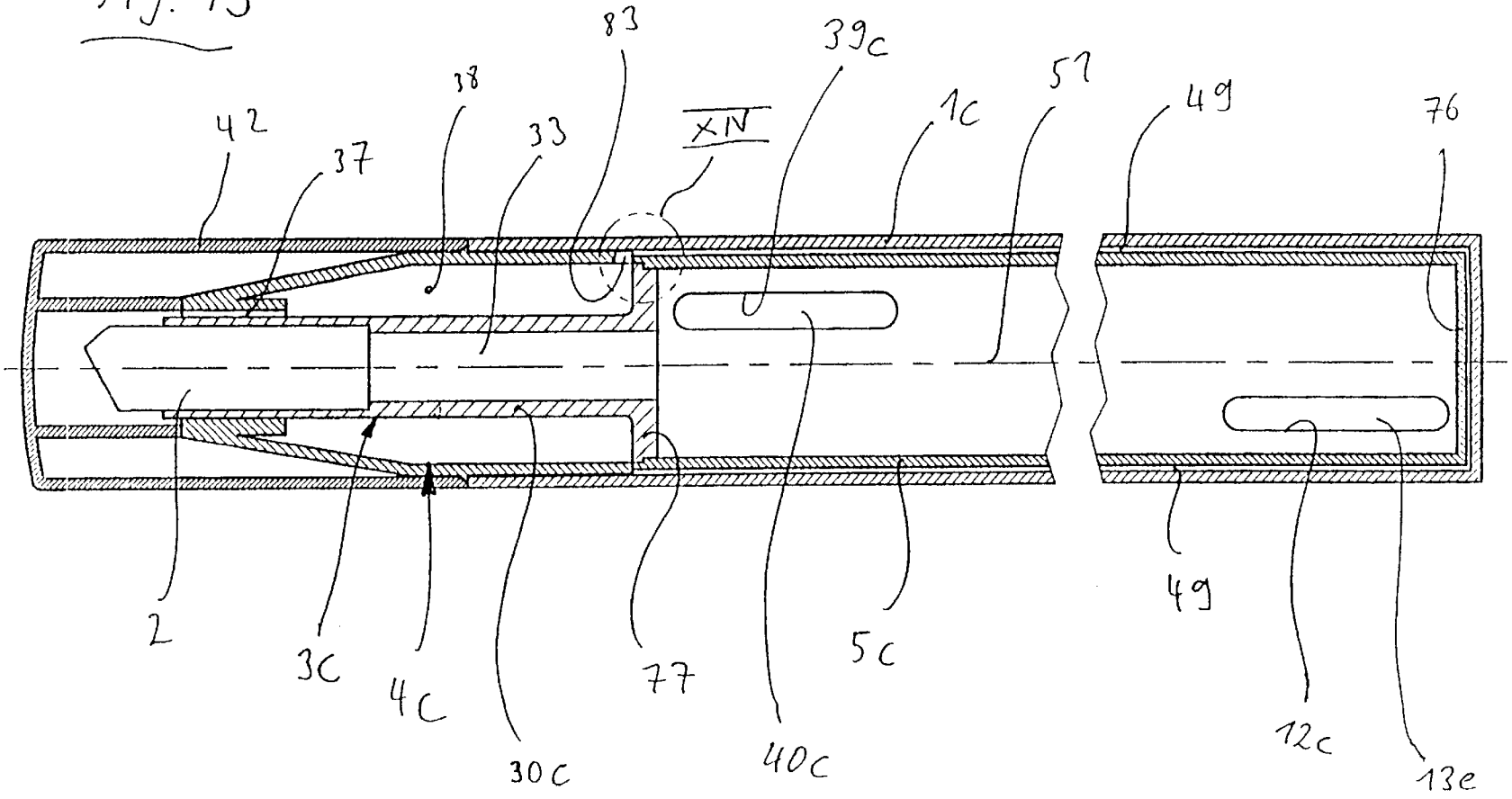
FIG. 13 is a fragmentary, longitudinal, cross-sectional view of a fourth embodiment of the application implement of FIG. 1 with an alternative embodiment of air-admission openings disposed in a circumferential wall of a fluid container.
Figure 14:
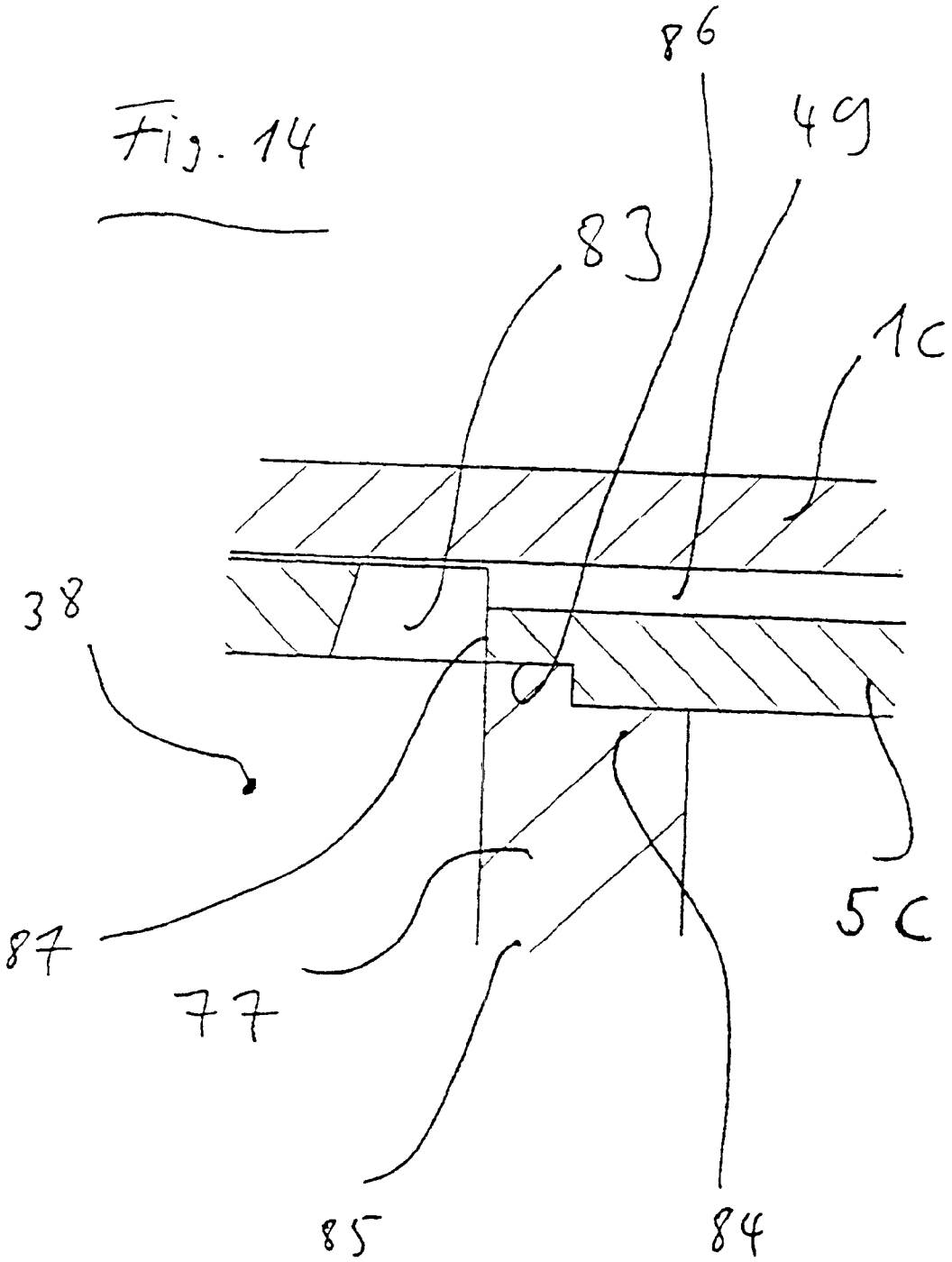
FIG. 14 is an enlarged, fragmentary, cross-sectional view of the detail XIV of FIG. 13.

The exemplary embodiment according to FIG. 13 is an application implement in which a separate container 5*c* is disposed in a shank 1*c*, an air-admission/extraction channel 49 being left free in the process. The container 5*c* is closed off at its rear end by an integrally formed end wall 76. The front end wall is formed by a flange 77, which is integrally formed at the rear end of the tube 30*c*. In the circumferential wall of the container 5*c*, at least one air-admission opening 39*c* is disposed in the front region and at least one air-admission opening 12*c* is disposed in the rear region. The air-admission openings 39*c*, 12*c* are configured in the manner of slots and extend in the direction of the center longitudinal axis 51. The air-admission openings 39*c*, 12*c* are closed off by semi-permeable diaphragms 40*c*, 13*e* and communicate with the air-admission channel 49. The mutually facing end sides of the tip part 4*c* and the container 5*c* butt against one another. In order to create a fluidic connection between the cavity 38 and the air-admission channel 49, a groove 83 is provided in that end side of the tip part 4*c* that is directed toward the container 5*c*. The flange 77 is inserted into the container 5*c* by way of a first longitudinal section 84. See FIG. 14. A second, radially outwardly widened longitudinal section 85 is positioned in an accommodating groove 86 in the front end side 87 of the container 5*c*.

Figure 15:
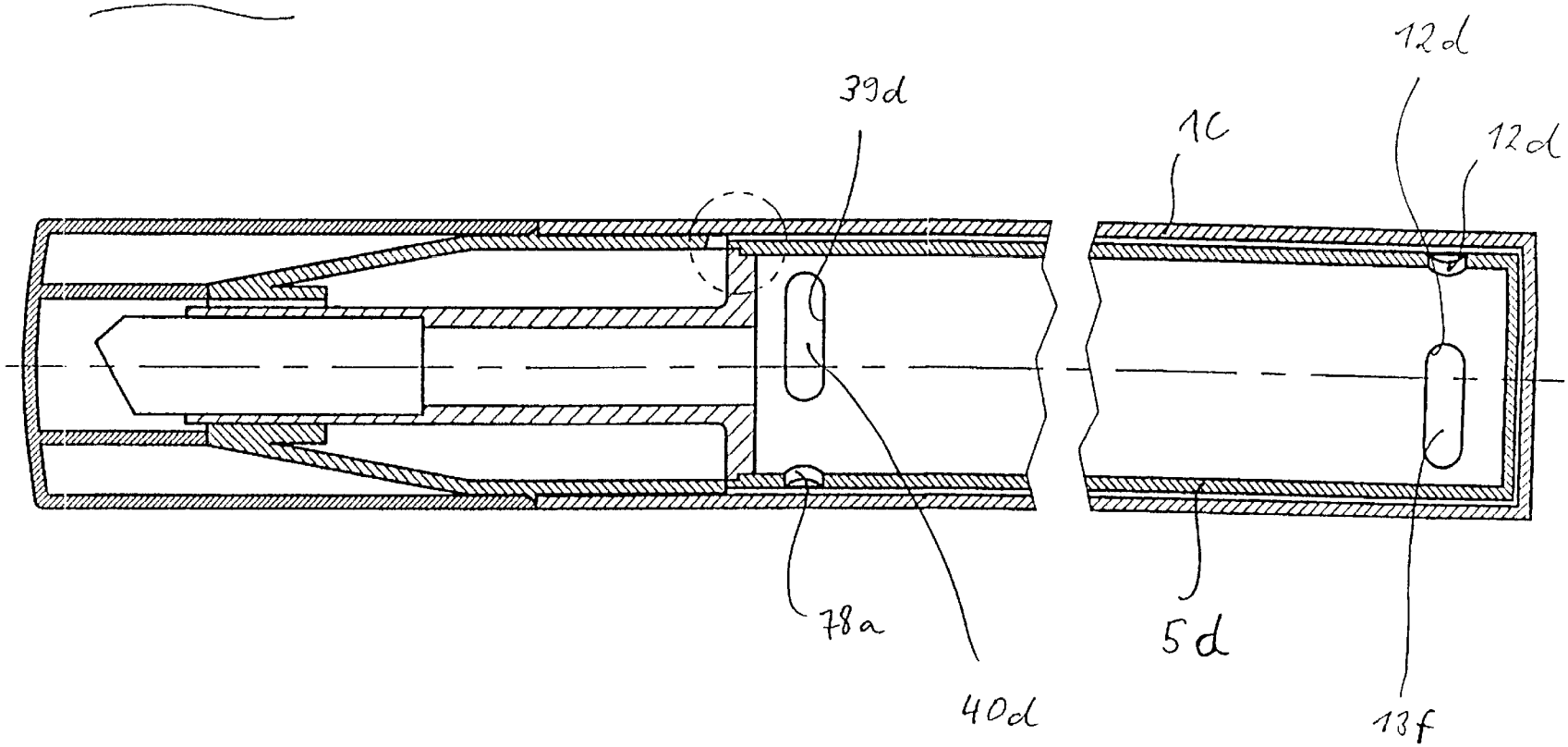
FIG. 15 is a fragmentary, longitudinal, cross-sectional view of a fifth embodiment of the application implement of FIG. 1 with another alternative embodiment of air-admission openings.
Figure 16:
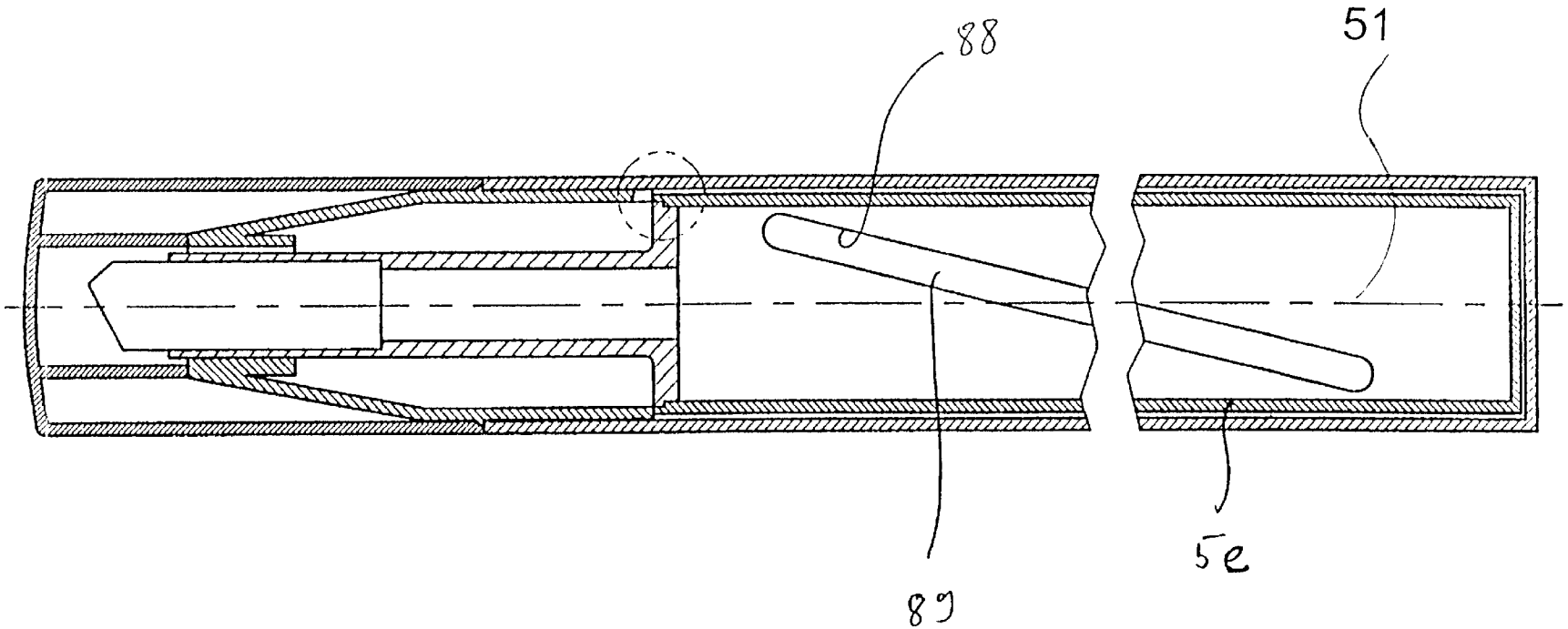
FIG. 16 is a fragmentary, longitudinal, cross-sectional view of a sixth embodiment of the application implement of FIG. 1 with a further alternative embodiment having a single air-admission opening extending from a shank end to another end of a fluid container.

In the exemplary embodiment illustrated in FIG. 15, in each case a plurality of air-admission openings 39*d*, 12*d* are provided in the front and rear regions of the container 5*d*. The air-admission openings 39*d*, 12*d* likewise are configured in the form of slots, but extend in the circumferential direction, and are closed off by semi-permeable diaphragms 40*d*, 13*f*. The rest of the configuration of the application implement from FIG. 15 corresponds to that from FIG. 13. In the application implement according to FIG. 16, finally, a single air-admission opening 88 is provided extending from the front container region to the rear container region and likewise is configured in the form of a slot. The air-admission opening 88 extends obliquely in relation to the center longitudinal axis 51, or runs helically, and is closed off by a semi-permeable diaphragm 89. The diaphragm 89, in the same way as those described above, is a thin sheet, a woven fabric, a sintered material, or a combination of these materials.

Figure 17:
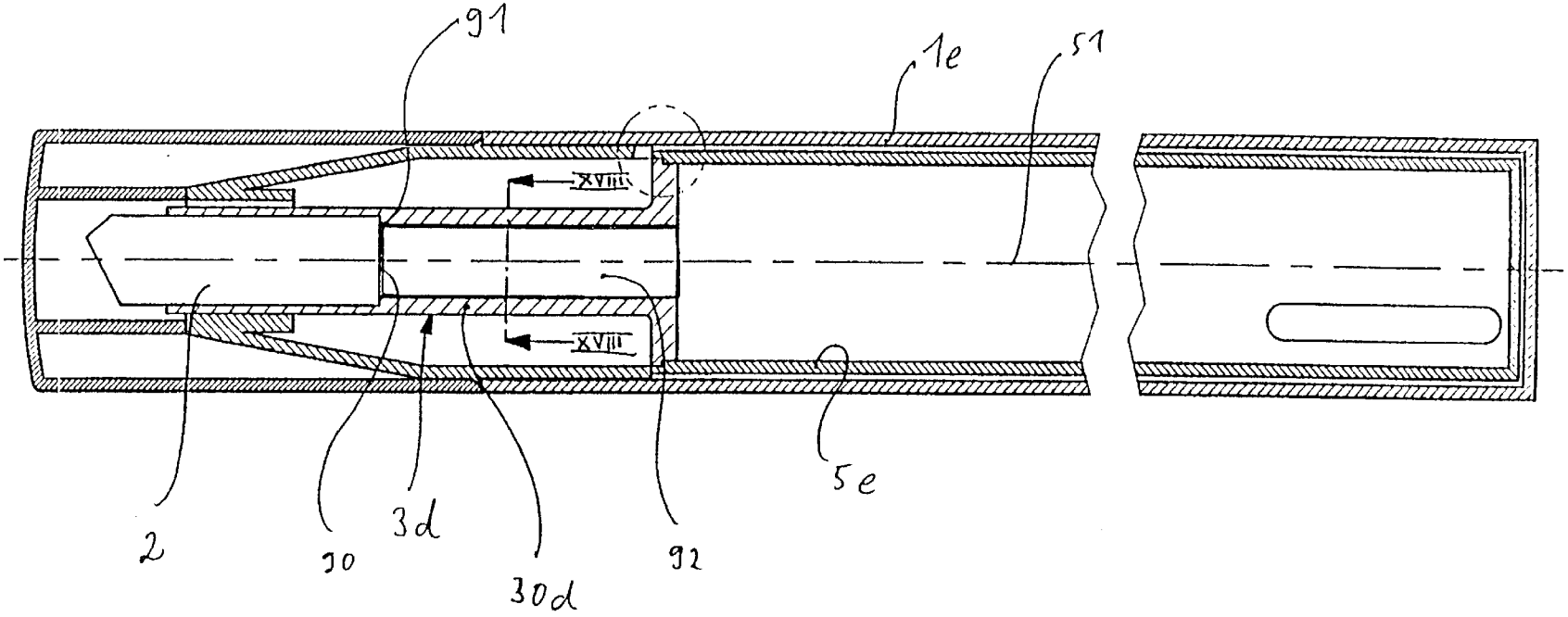
FIG. 17 is a fragmentary, longitudinal, cross-sectional view of a seventh embodiment of the application implement of FIG. 1.
Figure 18:
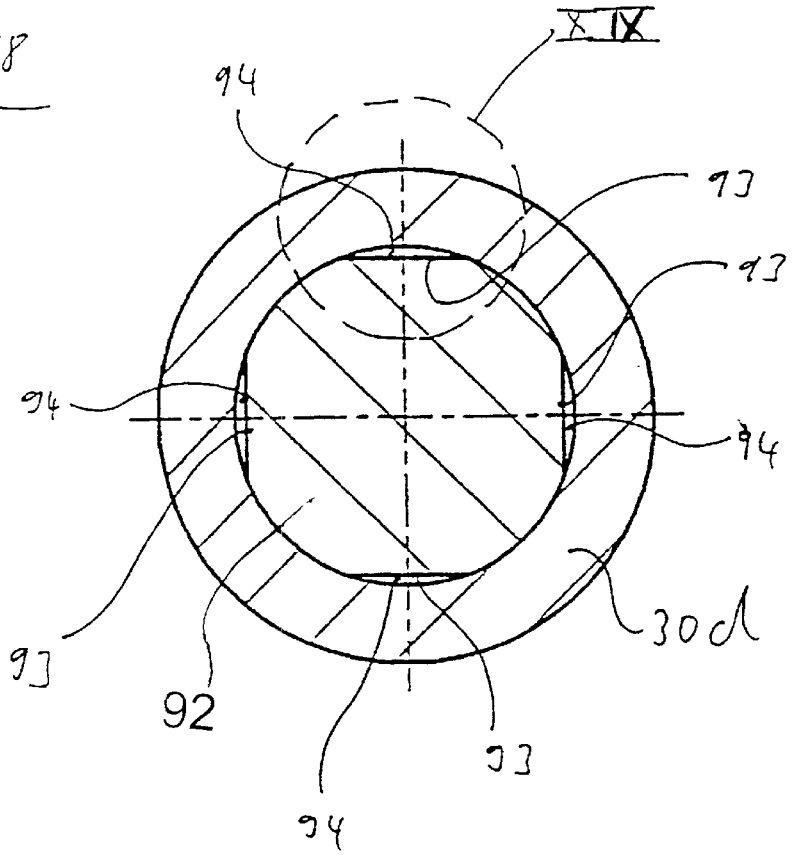
FIG. 18 is an enlarged, cross-sectional view of the embodiment of FIG. 17 across line XVIII—XVIII.
Figure 19:
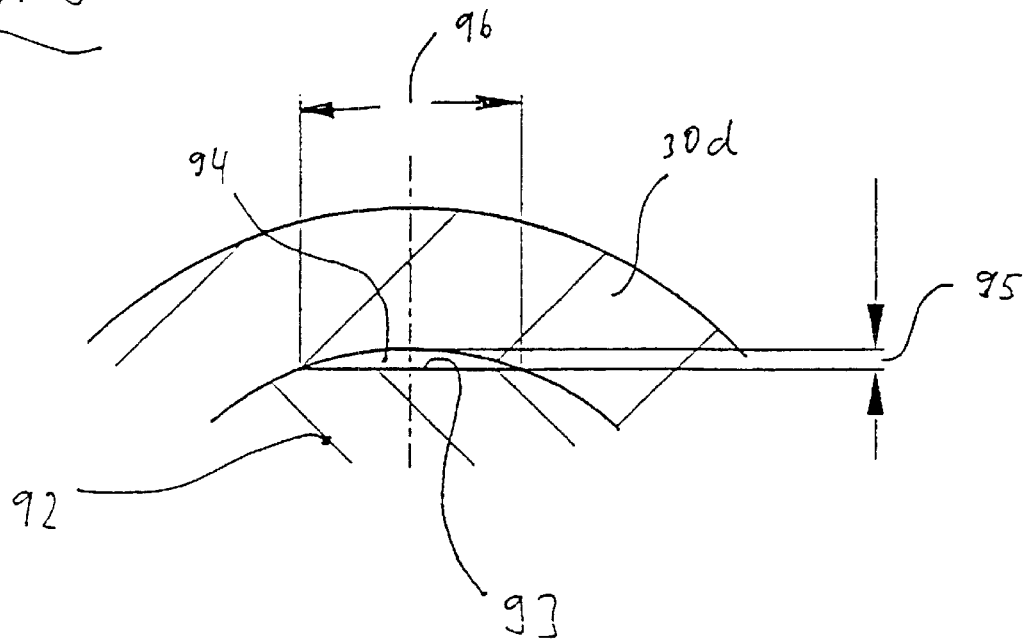
FIG. 19 is an enlarged, fragmentary, cross-sectional view of the detail XIX of FIG. 18.

The exemplary embodiment according to FIG. 17 corresponds essentially to that from FIG. 13, although air admission to the container 5*e* in the front region thereof takes place through the fluid-directing system 3*d* rather than through an air-admission opening or semi-permeable diaphragm. Accordingly, the fluid-directing system is configured differently. The tube 30*d* bears the writing tip 2 in its front region, which is widened radially from the inside. The writing tip 2 is supported, by way of its rear end side 90, on an inwardly projecting radial shoulder 91. Positioned in that region of the tube 30*d* that adjoins the radial shoulder 91 in the rearward direction is a cylindrical insert 92, of which the circumferential surface is configured in a manner complementary to the inner surface of the tube 30*d*. Flattened portions 93 (see FIGS. 18, 19), however, are provided in the circumferential surface of the insert 92 and extend axially over the entire length of the insert. Together with the inner surface of the tube 30*d*, the flattened portions bound fluid channels 94. Through the fluid channels 94, fluid can pass from the container 5*e* to the writing tip 2. The writing tip is a capillary material and absorbs the fluid more or less in itself. The fluid channels 94 subject the fluid to a considerably lower level of capillary action than conventional materials used for fluid-directing systems, for example, fibrous materials or sintered materials. The capillary pressure that feeds the fluid in the direction of the writing tip with the tip retained in the downward direction is, thus, reduced, and fluid is prevented from dripping out in the case of the application implement being in the above-mentioned position. The flattened portions 93 may extend parallel to the center longitudinal axis 51. It is also conceivable, however, for them to diverge slightly in the direction of the shank 1*e*. Thus, the cross-sectional surface area of the fluid channels 94 decreases in the direction of the container 5*e*. Accordingly, their capillary action in relation to the fluid increases. By virtue of such a configuration, it is, thus, possible to produce a capillary action in the direction of the container and, therefore, to restrict further the inflow of fluid to the writing tip 2. In the case of the extraction of air with the writing tip retained in the upward direction, the fluid channels 94 are initially still filled with fluid. As soon as a pressure builds up in the container, however, the fluid is displaced from at least one fluid channel. As a result, an air-extraction channel is then available. To create a connection between these channels and the atmosphere, non-illustrated air-extraction channels may be provided between the outer circumference of the writing tip and the tube 30*d*. The air extraction may also take place, however, through free capillaries of the writing tip.

The insert 92 need not necessarily extend as far as the rear end of the tube 30*d*. It preferably has a length of 5 to 30 mm. Its diameter varies between values of 2 mm and 5 mm. The height 95 of a fluid channel 94 is preferably in the range of from 0.02 to 0.10 mm. The width 96 of the flattened portions 93 is obtained from the respective diameter of the insert 92.

We claim:

1. An implement for applying a fluid, comprising:

a sleeve-like shank having a container, said container having:

an interior accommodating a fluid;

a front end;

a rear end, said front end and said rear end each fluidically connected to the atmosphere for admitting air into and extracting air from said interior; and at least one air-admission opening disposed at said rear end of said container and opening said interior to the atmosphere;

a diaphragm permeable to air and impermeable to the fluid, said diaphragm closing off said at least one air-admission opening;

a writing tip of a capillary material, said tip connected to said shank; and a fluid-directing system fluidically connecting said writing tip to the fluid in said interior with said capillary material, said fluid-directing system directing fluid from said interior of said container to said writing tip.

2. The implement according to claim 1, including a second diaphragm permeable to air and impermeable to the fluid, said at least one air-admission opening including an air-admission opening at said front end, and said air-admission opening at said front end being closed off by said second diaphragm.

3. The implement according to claim 2, wherein:

said container has a container wall with an inside surface and an outside surface; and said diaphragm and said second diaphragm are each disposed on one of the group consisting of said outside surface and said inside surface.

4. The implement according to claim 2, wherein said container is made by injection molding with at least one of said diaphragm and said second diaphragm molded therein.

5. The implement according to claim 1, wherein said container is made by injection molding with said diaphragm molded therein.

6. The implement according to claim 1, wherein said fluid-directing system has:

a tube with a substantially radially projecting flange; and said flange forms a front end wall of said container.

7. The implement according to claim 6, wherein said tube, said flange, and said container are integral.

8. The implement according to claim 6, wherein said tube, said flange, and said container are formed in one piece.

9. The implement according to claim 1, wherein:

said container has a circumferential wall; and said shank forms said circumferential wall of said container.

10. The implement according to claim 9, wherein:

said shank has a rear end and an outside;

a stopper has an inside and closes off said rear end of said shank; and an air-admission channel fluidically communicating with the atmosphere is disposed between said inside of said stopper and said outside of said shank.

11. The implement according to claim 1, wherein said container is separate from said shank and is disposed in said shank.

12. The implement according to claim 11, wherein:

said container has an outer surface;

said shank has an inner surface;

said at least one air-admission opening is at least one rear air-admission opening; and an air channel is disposed between said outer surface of said container and said inner surface of said shank and fluidically communicates with said at least one rear air-admission opening.

13. The implement according to claim 12, wherein:

said fluid-directing system has a tube;

a substantially sleeve-like tip part:

encloses said tube at a radial spacing therefrom;

defines a cavity; and defines an air channel fluidically connected to the atmosphere and open to said cavity;

said cavity fluidically communicates with the atmosphere through said air channel; and said air channel is disposed between said tube and said tip part.

14. The implement according to claim 12, wherein:

said container has a circumferential wall; and said at least one air-admission opening includes an air-admission opening disposed in said circumferential wall of said container.

15. The implement according to claim 14, wherein said air-admission opening in said circumferential wall of said container is at least one elongate air-admission opening extending from said front end of said container to said rear end of said container.

16. The implement according to claim 11, wherein said container is an exchangeable cartridge.

17. The implement according to claim 16, wherein:

said cartridge has a front end wall defining a central opening;

said fluid-directing system has a tube with a rear end; and said rear end of said tube is inserted releaseably into said central opening.

18. The implement according to claim 1, wherein:

said fluid-directing system has a tube with an interior having an inner cross-section;

said writing tip has a rear longitudinal section disposed in said tube;

an insert is disposed in said interior of said tube and narrows said inner cross-section to form at least one longitudinally extending fluid channel in said interior of said tube; and said fluid channel adjoins said writing tip and fluidically communicates with the atmosphere for admitting air into and extracting air from said front end of said container.

19. The implement according to claim 18, wherein:

said tube has an inner tube wall;

said insert has:

a circumferential section abutting said inner tube wall; and at least one flattened portion disposed at a distance from said inner tube wall; and said inner tube wall and said flattened portion define said fluid channel.

20. The implement according to claim 19, wherein said fluid channel has a cross-sectional surface area decreasing in a direction of said container.

21. A stick-like writing implement for applying a fluid, comprising:

a sleeve-like shank having a container, said container having:

an interior accommodating a fluid;

a front end;

a rear end;

said front end and said rear end each fluidically connected to the atmosphere for admitting air into and extracting air from said interior; and at least one air-admission opening disposed at said rear end and fluidically connecting said interior to the atmosphere;

a diaphragm permeable to air and impermeable to the fluid, said diaphragm closing off said at least one air-admission opening;

a writing tip of a capillary material, said tip connected to said shank; and a fluid-directing system fluidically connecting said writing tip to the fluid in said interior with said capillary material, said fluid-directing system directing fluid from said interior of said container to said writing tip.

22. A stick-like cosmetics implement for applying a fluid, comprising:

a sleeve-like shank having a container, said container having:

an interior accommodating a fluid;

a front end;

a rear end;

said front end and said rear end each fluidically connected to the atmosphere for admitting air into and extracting air from said interior; and at least one air-admission opening disposed at said rear end and fluidically connecting said interior to the atmosphere;

a diaphragm permeable to air and impermeable to the fluid, said diaphragm closing off said at least one air-admission opening;

a writing tip of a capillary material, said tip connected to said shank; and a fluid-directing system fluidically connecting said writing tip to the fluid in said interior with said capillary material, said fluid-directing system directing fluid from said interior of said container to said writing tip.

* * * * *

UNITED STATES PATENT AND TRADEMARK OFFICE

CERTIFICATE OF CORRECTION

PATENT NO. : 6,503,016 B2
DATED : January 7, 2003
INVENTOR(S) : Jürgen Raps et al.

It is certified that error appears in the above-identified patent and that said Letters Patent is hereby corrected as shown below:

Title page,
Item [30], should read as follows:

-- Apr. 17, 1999 (DE) ……. 199 17 514.4 --

Signed and Sealed this

Sixth Day of May, 2003

JAMES E. ROGAN
*Director of the United States Patent and Trademark Office*